US009248961B2

(12) United States Patent
Trank et al.

(10) Patent No.: US 9,248,961 B2
(45) Date of Patent: Feb. 2, 2016

(54) SECURITY LOCK FOR STORAGE TANKS

(75) Inventors: Andrew D. Trank, Orchard Park, NY (US); Jeffrey R. Sullivan, Boston, NY (US); David C. Meyer, Boston, NY (US)

(73) Assignee: McGard LLC, Orchard Park, NY (US)

( * ) Notice: Subject to any disclaimer, the term of this patent is extended or adjusted under 35 U.S.C. 154(b) by 779 days.

(21) Appl. No.: 13/478,714

(22) Filed: May 23, 2012

(65) Prior Publication Data

US 2012/0298218 A1 Nov. 29, 2012

Related U.S. Application Data

(60) Provisional application No. 61/488,925, filed on May 23, 2011.

(51) Int. Cl.
*B65D 90/22* (2006.01)

(52) U.S. Cl.
CPC ..... *B65D 90/22* (2013.01); *B65D 2211/00* (2013.01); *Y10T 29/49826* (2015.01); *Y10T 137/7069* (2015.04)

(58) Field of Classification Search
CPC ..... B65D 3/00; B67C 3/00
USPC ..... 220/86.3, 315; 137/382, 383; 70/158, 70/163–165, 174–178, 180, 229, 232
See application file for complete search history.

(56) References Cited

U.S. PATENT DOCUMENTS 1,984,590 A * 12/1934 Maddin ..... 220/86.1
2,133,520 A * 10/1938 Ritz-Woller ..... 220/86.3
3,002,649 A * 10/1961 Turley ..... 220/86.3
3,072,286 A * 1/1963 Cusumano ..... 220/326
3,308,990 A * 3/1967 Klasson et al. ..... 222/61
3,390,514 A * 7/1968 Raschke ..... 96/421
3,605,460 A * 9/1971 Singer et al. ..... 70/232
3,951,297 A 4/1976 Martin
3,991,792 A 11/1976 Kettler
4,269,221 A * 5/1981 Adams ..... 137/383
4,295,577 A * 10/1981 Schmid et al. ..... 220/86.1
4,343,410 A 8/1982 Lenda
4,630,748 A 12/1986 Keller
4,723,569 A * 2/1988 Ellis ..... 137/385
4,986,097 A * 1/1991 Derman ..... 70/158
5,476,185 A 12/1995 Jimerson
5,607,084 A * 3/1997 George ..... 222/153.03
5,690,141 A * 11/1997 Creaghe ..... 137/382
5,791,371 A * 8/1998 Kemp, II ..... 137/383
6,170,306 B1 * 1/2001 Kitley et al. ..... 70/178
6,302,383 B1 * 10/2001 Scarr ..... 261/71
6,644,075 B2 * 11/2003 Thompson ..... 70/232
6,854,302 B2 * 2/2005 Zapushek et al. ..... 70/34
7,040,360 B2 5/2006 Watson
7,404,498 B2 * 7/2008 Hattori et al. ..... 220/86.3

(Continued)

*Primary Examiner* — Craig Schneider
*Assistant Examiner* — Daniel P Donegan
(74) *Attorney, Agent, or Firm* — Walter W. Duft

(57) ABSTRACT

A security lock for a storage tank includes a lock ring configured for engaging an opening that provides access to the storage tank. A suitable mounting assembly is used to mount the lock ring to the opening. One or more obstructions are disposed within an inside (and/or outside) area of the lock ring. The one or more obstructions define one or more openings that are sized to allow storage tank contents to be introduced through the security lock while blocking pipes, tube or other implements that are larger than the openings so that such implements cannot be used for siphoning or otherwise removing the storage tank contents.

16 Claims, 14 Drawing Sheets

(56) References Cited

U.S. PATENT DOCUMENTS

| | | | | |
|---|---|---|---|---|
| D588,055 | S * | 3/2009 | Moya | D12/400 |
| 7,721,902 | B2 | 5/2010 | Grote et al. | |
| 7,845,367 | B2 * | 12/2010 | Abe | 137/385 |
| 8,181,678 | B2 * | 5/2012 | Ando et al. | 141/286 |
| 8,240,500 | B2 | 8/2012 | Dalton, Jr. et al. | |
| 8,281,947 | B2 * | 10/2012 | Walkowski et al. | 220/86.3 |
| 8,353,309 | B1 * | 1/2013 | Embry et al. | 137/385 |
| 8,512,911 | B2 * | 8/2013 | Curello et al. | 429/515 |
| 8,550,279 | B2 * | 10/2013 | Avakian | 220/86.3 |
| 8,733,140 | B2 * | 5/2014 | Jones | 70/225 |
| 2004/0103942 | A1 * | 6/2004 | Brown | 137/383 |
| 2007/0215213 | A1 * | 9/2007 | Fox | 137/383 |
| 2011/0203680 | A1 * | 8/2011 | Pierson | 137/383 |

* cited by examiner 220
202
240B
222
222
204
240A
222
220
220
252
240C
240
250
256
254

320
322
302
304
322
322
320
352
320
350
356
354

SECURITY LOCK FOR STORAGE TANKS

CROSS-REFERENCE TO RELATED APPLICATIONS

This application claims priority to and the benefit under 35 U.S.C. 119(e) of U.S. Provisional Application No. 61/488,925 filed on May 23, 2011. The entire contents of said Provisional Application No. 61/488,925 are hereby incorporated by this reference as if fully set forth herein.

BACKGROUND

1. Field

The present disclosure relates to storage tank security products, and particularly security locks for installation in storage tank access openings.

2. Description of the Prior Art

By way of background, storage tanks are used to store many different types of materials, including fuel, chemicals, and water, to name but a few. Storage tanks typically include at least one inlet, outlet, or other access opening that provides a pathway to the tank interior containing the stored contents. Such access openings are necessary for normal tank utilization, but unfortunately, can also facilitate removal of the stored contents in an unauthorized manner, such as by pumping, siphoning, or other means. For example, underground fuel tanks that store gasoline at filling stations are accessed through a surface-level pipe inlet opening (fill port) covered by a locking or non-locking cover (fill cap). Non-locking fill caps present no impediment to theft of the stored gasoline. So long as the thieves can operate without discovery, the tank contents are theirs for the taking. The use of locking fill caps can be a substantial deterrent to gasoline theft, but such devices must be unlocked every time a gasoline delivery is made. This is problematic if the delivery person does not have a matching security key and a delivery is made at night or at other times when the filling station is closed.

It is to improvements in the securement of storage tanks that the present disclosure is directed. In particular, the disclosed subject matter provides a security solution that offers meaningful protection against unauthorized removal of storage tank contents, but not require removal when authorized access is required.

SUMMARY

A security lock for a storage tank includes a lock ring configured for engaging an opening that provides access to the storage tank. A suitable mounting assembly is used to mount the lock ring to the opening. One or more obstructions are disposed within an inside (and/or outside) area of the lock ring. The one or more obstructions define one or more openings that are sized to allow storage tank contents to be introduced through the security lock while blocking pipes, tubes or other implements that are larger than the openings so that such implements cannot be used for siphoning or otherwise removing the storage tank contents.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Introduction

Figure 1:
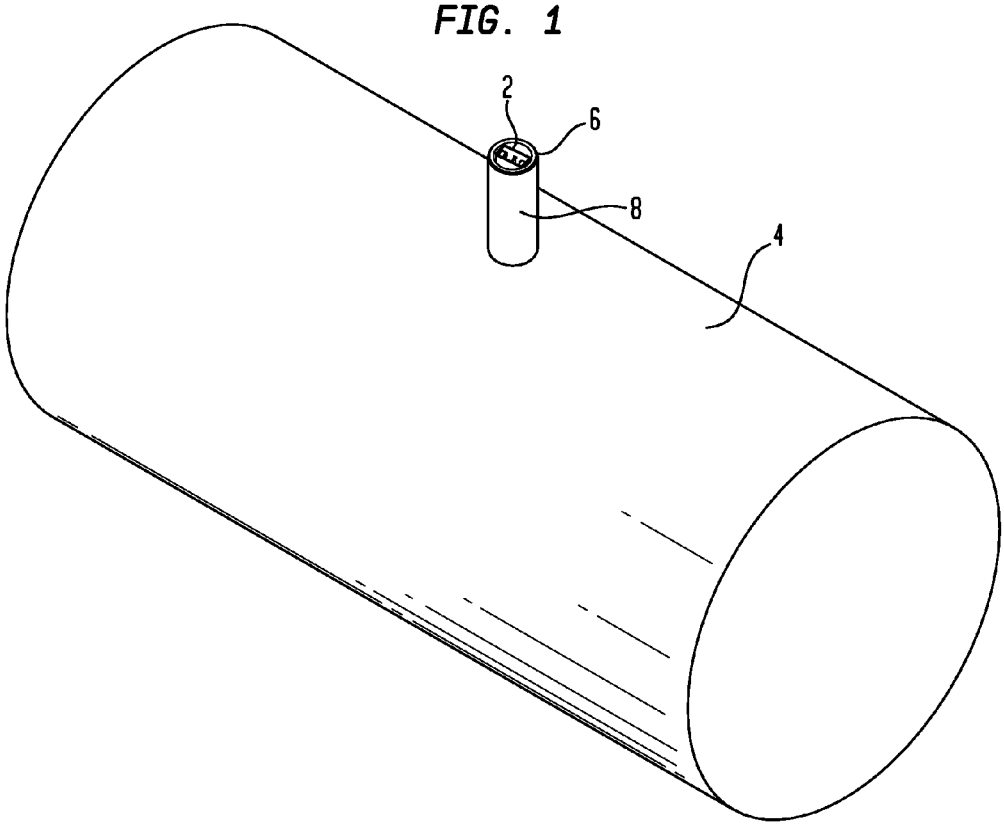
FIG. 1 is a diagrammatic perspective view showing an example storage tank that includes an inlet pipe having a fill port opening.

Turning now to the drawings, which are not necessarily to scale, various alternate embodiments of a storage tank security lock will now be described. The disclosed security lock embodiments are designed for convenient installation in storage tank inlets, outlets, piping, and various other access openings through which the contents being stored (e.g., fuel, chemicals, water, etc.) could otherwise be removed by pumping, siphoning, or other means. Each security lock includes a lock ring configured to engage the storage tank access opening, a mounting assembly operable to mount the lock ring to the access opening, and one or more blocking obstructions that partially block the area within (and/or outside) the lock ring. The one or more obstructions restrict the size of pipe or hose that can pass through the access opening, and greatly restrict or eliminate the unauthorized removal of storage tank contents. At the same time, the one or more obstructions allow a tank stick or other small measuring instruments to pass through the security lock and measure the content level in the tank. Flow loss is minimized when the tank is being filled. The disclosed security locks can be mounted and secured in the storage tank access opening in a number of ways. Examples include the use of (1) bolts (or screws or other fasteners) with a unique security drive pattern and matching key, (2) an expanding ring, (3) welding, or (4) various other mounting assembly methods to prevent easy removal of the device without a mating key, specialized tools, or extremely destructive methods.

Summary of Disclosed Embodiments

Each disclosed security lock embodiment includes a lock ring having shrouded security fasteners (bolts) as the preferred means of attachment. The security bolts pass through the wall of the lock ring, pointing outward, and are preferably evenly spaced around the ring's circumference. The lock ring may have any desired configuration. The disclosed embodiments illustrate a generally rectangular configuration (Embodiment 1) and generally circular configurations (Embodiments 2-6). Other lock ring configurations may also be used, including other polygonal shapes (e.g., triangles, hexagons, octagons, etc.) and other curvilinear shapes (e.g., ellipses). A minimum of one security bolts is used to secure the lock ring to the storage tank access opening, with two or more security bolts being preferred. The head and drive portion of the security bolts are on the inside of the lock ring. The points of the bolts are towards the outside of the lock ring, where they are positioned to grip the inside of the access opening to be secured. In particular, the points of the security bolts are designed to grip a pipe liner or drop tube (typically made of aluminum) on the inside wall of a tank inlet pipe. The security bolts can be oriented perpendicular to the lock ring wall, or angled upward for easier installation. The heads of the security bolts are enclosed in individual shrouds (each of which may be referred to as a "lock shroud"). The shrouds prevent unauthorized removal of the security bolts and are sized for minimal clearance around the body of a mating security key assembly for added support and guidance of the key. The shrouds may be non-spinning (Embodiment 1) or free-spinning (Embodiments 2-6). In the non-spinning shroud embodiment, the shrouds are keyed or press-fit through the sidewall of the lock ring. Each security bolt is threaded through a threaded opening at the base of its corresponding shroud. In the free-spinning shroud embodiments, each security bolt is threaded through a threaded opening in the sidewall of the lock ring. Each security bolt's corresponding shroud may be installed by spinning it onto the bolt shank until the shroud reaches a bolt shank undercut (formed below the bolt head) that is sized to allow the shroud to spin.

The above-mentioned security key assembly has a security drive pattern that uniquely matches a security pattern on the face of each security bolt head. For example, the key assembly's security drive pattern could be formed as a set of recesses in a counterbore that receives a matching set of peripheral lobes on the security bolt head. Alternatively, the key assembly's security drive pattern could be formed as a curvilinear ridge that matches a curvilinear groove on the security bolt head. The security key assembly may include (or be combined with) a ratchet wrench or the like to turn the security drive pattern in order to advance or retract the security bolts.

In two of the illustrated embodiments (Embodiments 1, 2 and 3), the lock rings have grate structures that provide the blocking obstructions to partially block the area within (and/or outside) the lock ring. A wide variety of grate configurations may be used.

In one such embodiment (Embodiment 1), a generally rectangular lock ring mounts a single transverse grate bar that acts in conjunction with the lock ring sidewalls to form the grate structure. In another such embodiment (Embodiment 2), a generally circular lock ring mounts a grate structure comprising perpendicular grate parts that define four generally pie-shaped openings and two generally perpendicular openings. In another embodiment (Embodiment 3), a generally circular lock ring mounts a grate structure comprising oblique grate parts that define various openings of different shape. All of the grate openings are of restricted size. As mentioned above, the security lock will allow the storage tank to be filled and will also preferably allow a tank stick or other small measuring instrument to pass while blocking larger size siphon hoses and pipes. By way of example only, a standard tank stick used to determine fuel level in a gasoline service station storage tank is 13/16 inches square. In contrast, pipes and tubes used for siphoning or other unauthorized removal of storage tank contents are typically larger. Thus, a grate structure whose grate openings are approximately the same size or slightly larger than a standard tank stick may be sufficient. If desired, the grate parts may be recessed from the security bolts and shrouds so as to provide clearance for the key assembly and ratchet wrench. The grate parts may be integrally formed with the lock ring or they may be mounted thereto in any suitable fashion.

In three of the illustrated embodiments (Embodiments 3, 4 and 5), a conical spring (referred to as a "lock spring") is fastened to the lock ring to provide a blocking obstruction that partially blocks the area inside the lock ring. One end of each lock spring has a relatively large diameter and is fastened to the lock ring. The opposite free end of each lock spring has a relatively small diameter. The small end is sized and shaped to allow a measuring stick or other instrument to pass through the center thereof, but to prevent larger pipes or hoses from passing through and entering the storage tank. The lock spring is fastened onto a suitable portion of the lock ring, such as its lower edge or inside wall face. The lock spring may be attached to the lock ring by welding, crimping, or any other suitable method. When the security lock is installed, the small end of the lock spring points towards the tank contents that are to be secured and stored. One or more straight "side wires" or other structures may be fastened along the inside of the lock spring to add rigidity and prevent deformation, stretching, bending, or other damage caused by any attempt to compromise the lock and its security features. The lock spring may be used by itself (Embodiment 4) or in combination with other obstructing members, such as a grate structure (Embodiment 3).

In two embodiments (Embodiments 5 and 6), access-restricting obstructions are provided by using lengthened or larger shrouds to partially block the area within (and/or outside) the lock ring, thereby providing several obstructions that define several openings inside the lock ring. The long shroud design may be used by itself (Embodiment 6) or in combination with other obstructions, such as a lock spring (Embodiment 5).

During installation, the security lock may be placed several inches inside of a storage tank pipe inlet (or other access point opening), e.g., such that the top of the security lock is flush with the top of the pipe inlet. The axis of the lock ring and lock spring (if present) should be in-line with the axis of the pipe (or other access point opening). When the lock is in the desired position, the security bolts are tightened with the mating security key assembly. Once installed, the security lock does not need to be removed during storage tank filling.

Although the illustrated embodiments show storage tank security locks having grates and/or springs to provide obstructions that restrict unauthorized access, other types of access-restricting obstructions may be used in place of or in conjunction with grates and/or springs. Examples include a spiral channel, a group of individual tubes fastened along their outside surfaces in a bundle, screening, mesh, a solid blockage with a single hole (or several holes) in it, or any other type of obstruction or obstructions. The one or more obstructions will define one or more openings that allow storage tank contents to be introduced, and may also allow a tank stick or other small measuring instrument to pass. At the same time, the one or more obstructions will prevent storage tank contents from being removed by unauthorized means, such as siphoning.

All of the structures and parts used for the various embodiments may be constructed of metals and/or plastics suitable for the intended application environment and applicable strength requirements, and may be produced by casting, molding, welding, forging, or other suitable fabrication or manufacturing methods.

EXAMPLE EMBODIMENT 1

Figure 2:
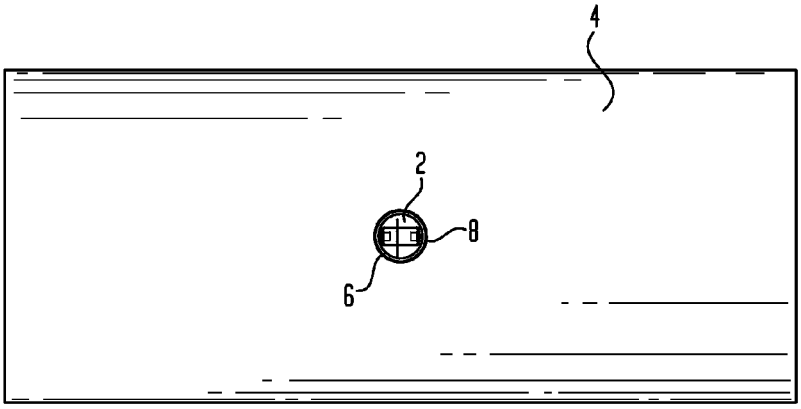
FIG. 2 is a top plan view showing the storage tank of FIG. 1, and further illustrating a first example security lock embodiment mounted in the fill port opening of the storage tank inlet pipe.
Figure 3:
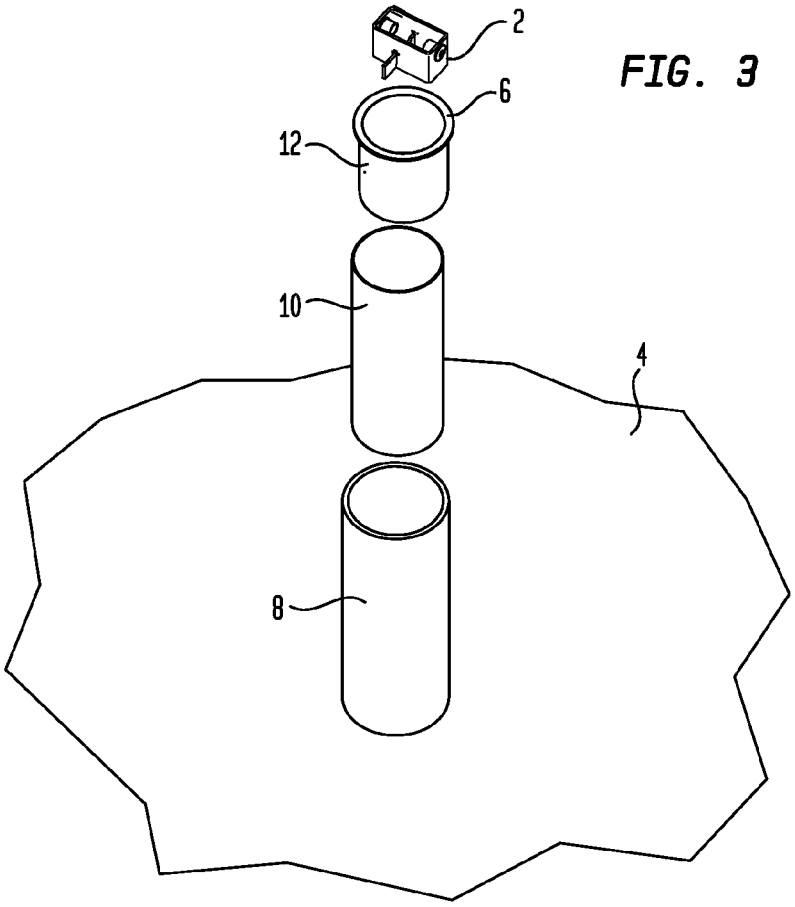
FIG. 3 is an exploded perspective view showing the security lock embodiment of FIG. 2 and components of the fill port and inlet pipe in which it is mounted.

Turning now to FIGS. 1 and 2, a storage tank security lock 2 is constructed in accordance with a first example embodiment is shown in combination with a storage tank 4. The security lock 2 is seated in an access opening 6 (fill port) at the mouth of a pipe inlet 8 that leads to the interior of the storage tank where tank contents are stored. As can be seen in FIG. 3, the pipe inlet 8 may include a conventional pipe liner 10 that supports a conventional pipe end adapter 12 that defines the access opening 6. Whereas the storage tank 2 and its pipe inlet 8 may be formed from a relatively hard material such as steel or the like, the pipe liner 10 and the pipe end adapter 12 are typically made from a softer material, such as aluminum. As described in more detail below, the use of a softer material for the pipe end adapter 12 facilitates mounting security lock 2 therein using a fastener-based mounting technique.

Figure 4:
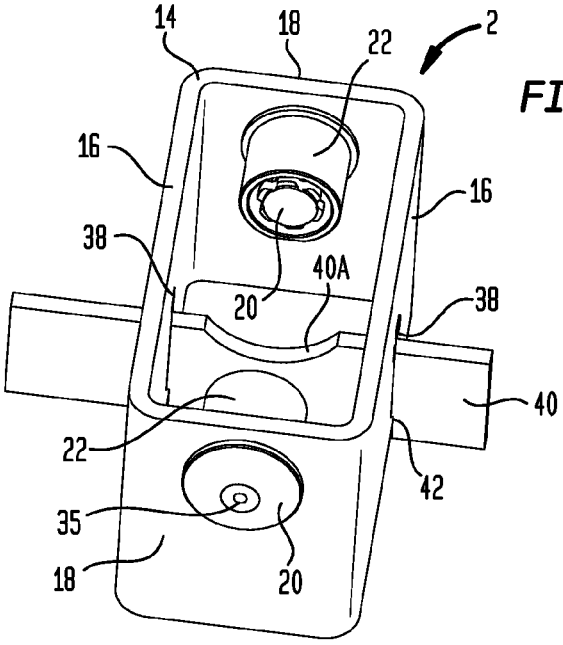
FIG. 4 is a perspective view showing the security lock embodiment of FIG. 2.
Figure 5:
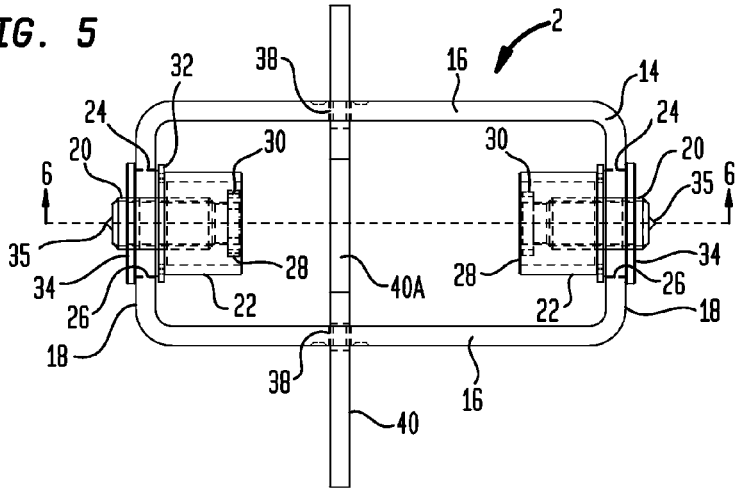
FIG. 5 is a top plan view showing the security lock embodiment of FIG. 2.
Figure 6:
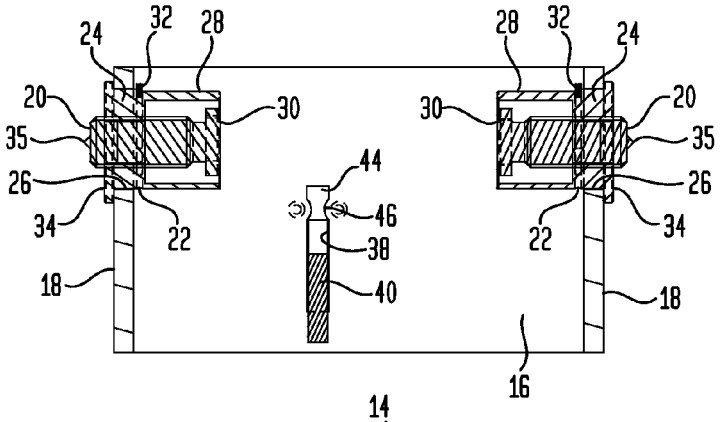
FIG. 6 is a cross-sectional view taken along line 6-6 in FIG. 5.

Turning now to FIGS. 4-6, the security lock 2 comprises a lock ring 14 that is generally rectangular in shape, and includes two long sidewalls 16 and two short sidewalls 18. Each short sidewall 18 mounts a shrouded security fastener comprising a security bolt 20 disposed within a non-spinning shroud 22. The shrouded security fasteners collectively represent one embodiment of a mounting assembly that may be used to mount the security lock 2 in the access opening 6. As best shown in FIG. 6, each shroud 22 includes a base 24 having a central threaded bore 26 into which a corresponding one of the security bolts 20 is adjustably threaded. A tubular shroud body 28 extends inwardly into the lock ring interior and is sized to surround the head portion 30 of each security bolt 20. The shroud body 28 is preferably closely spaced with respect to the bolt head 30 so as to limit the ability to grip the bolt head with an unauthorized tool. The base 24 of each shroud 22 is secured to a corresponding one of the short sidewalls 18 by a snap ring 32 received in a corresponding annular groove that may be formed in the base. The snap ring 32 bears against the inside surface of the corresponding short sidewall 18. An annular flange 34 may be formed on the shroud base 24 in order to bear against the outside surface of the short sidewall 18. The outwardly extending ends of the security bolts may be formed with points 35 to facilitate mounting the security lock 2 in a storage tank access opening.

Figure 7:
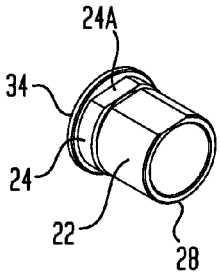
FIG. 7 is a perspective view showing an example shroud component of the security lock embodiment of FIG. 2.
Figure 8:
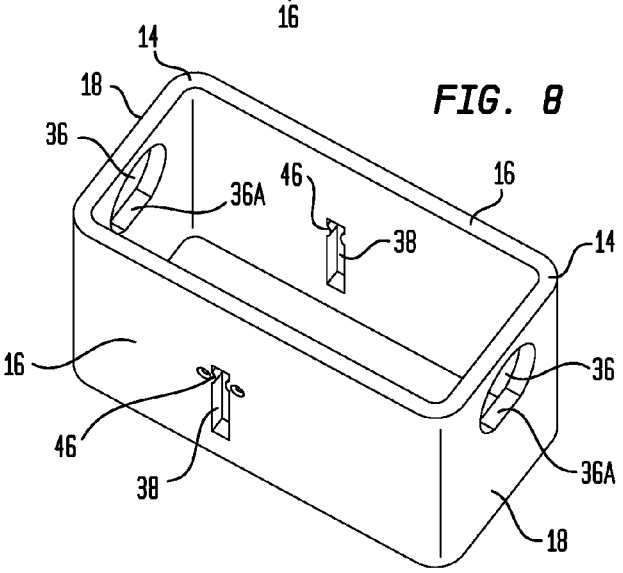
FIG. 8 is a perspective view showing a lock ring component of the security lock embodiment of FIG. 2.
Figure 9:
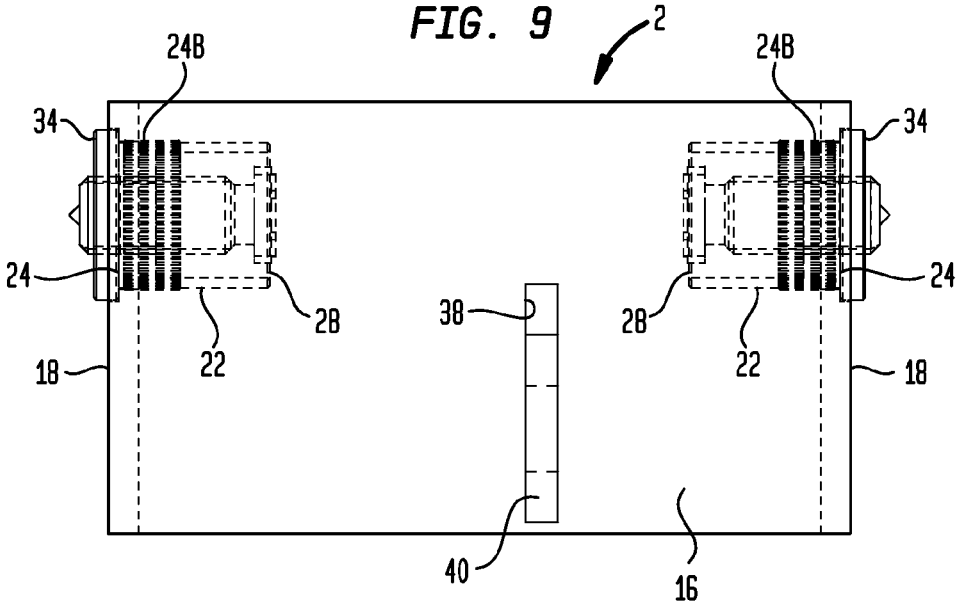
FIG. 9 is a side elevation view showing the security lock embodiment of FIG. 2 with an alternate shroud component.
Figure 10:
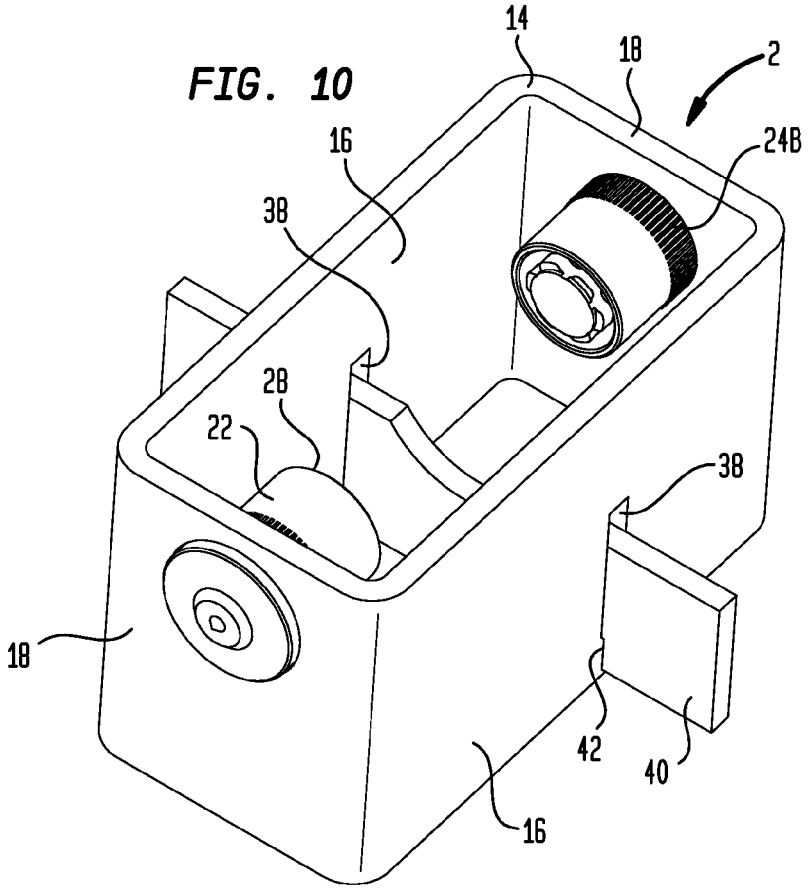
FIG. 10 is a perspective view showing the security lock embodiment of FIG. 2 with the alternate shroud component of FIG. 9.

As can be seen in FIGS. 7 and 8, the shrouds 22 may be fixed against rotation by keying them to the short sidewalls 18. In particular, each short sidewall 18 may be provided with a shroud-receiving bore 36 having a flat 36A on one side. Correspondingly, the base 24 of each shroud 22 may be formed with a matching flat 24A. It will be appreciated that other rotation-fixing configurations may be used. For example, as shown in FIGS. 9 and 10, the base 24 of the shroud 22 could be formed with a friction-enhancing surface texture 24B, such as knurling or the like, and could be press-fit into the shroud-receiving bore 36 of the corresponding short sidewall 18. Note that in lieu of a non-spinning shroud, a free-spinning shroud construction as described below in connection with Embodiments 2-6 could also be used.

Each long sidewall 16 of the security lock 2 is formed with a vertical main slot 38, and these slots are aligned with each other to receive a grate bar 40. The grate bar 40 acts in conjunction with the lock ring 14 to form a grate structure that blocks unauthorized access to storage tank contents. In particular, the grate bar 40 divides the generally rectangular area inside the lock ring 14. As can be additionally seen in FIG. 11, outside the lock ring 14, the grate bar 40 divides the partially circular areas that are formed between the long sidewalls 16 and the storage tank access opening 6 when the lock ring is installed. The grate bar 40 may be attached to the long sidewalls in any suitable manner. In the present embodiment, the grate bar 40 has two lower mounting slots (see FIG. 4) that respectively engage the lower ends of the main slots 38 on the long sidewalls. During installation, the grate bar is passed through the upper portion of the main slots 38, and is then pushed down to interlock the grate bar mounting slots 42 with the bottom edge of the main slots. To retain the grate bar 40 in this position, the upper ends 44 of the main slots 38, which are now gapped from the top of the grate bar, can be suitably deformed (as by staking) at 46 (see FIG. 6) to close the gap and secure the grate bar against upward movement. As can be seen in FIGS. 4 and 5, a central portion of the grate bar 40 can be reduced in height to form with a depression 40A that is recessed from the shrouded security fasteners. The depression provides clearance for a security key assembly (described below) that is used to actuate the security bolts 20.

Figure 12:
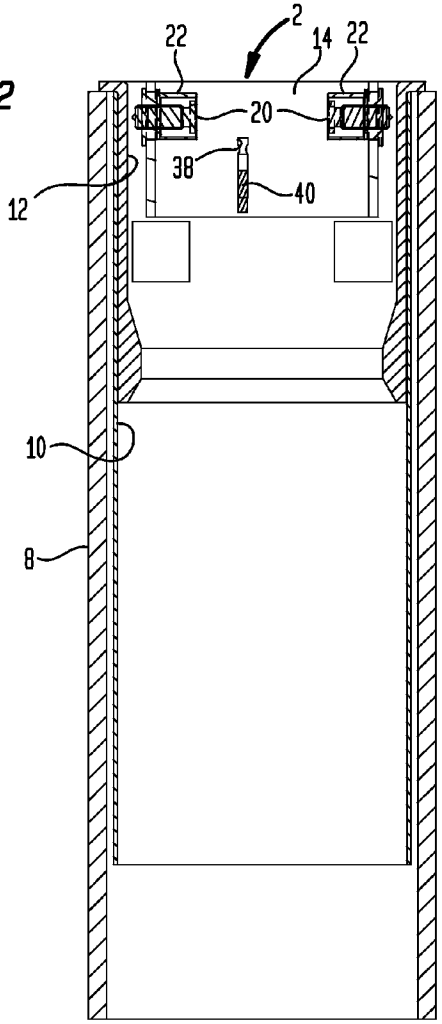
FIG. 12 is a cross-sectional view taken along line 12-12 in FIG. 11.
Figure 11:
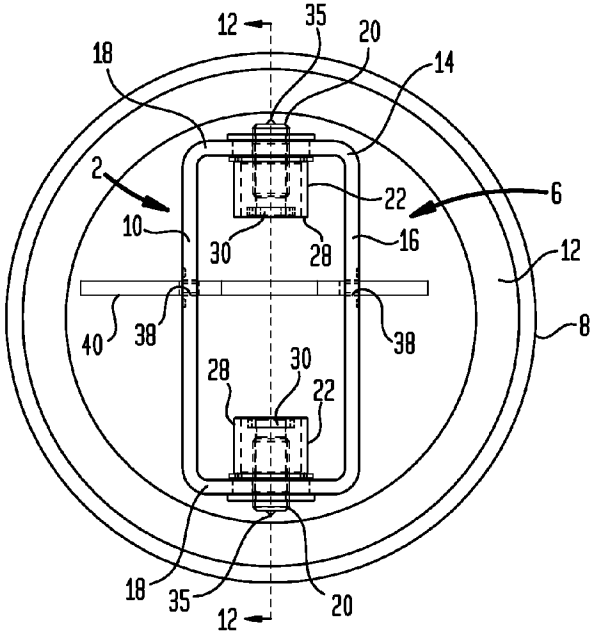
FIG. 11 is a top plan view showing the security lock embodiment of FIG. 2 installed in the pipe inlet of the storage tank of FIG. 1.

FIGS. 11 and 12 show the security lock 2 installed in the storage tank access opening 6. As can be seen in FIG. 11, the security bolts 20 are advanced outwardly until the points 35 thereon engage the inside wall of the pipe end adapter 12. The points 35 may be formed of a harder material than the pipe end adapter 12, such that they will dig in to the pipe end adapter surface for added security. As can be seen in FIG. 12, the security lock 2 may be installed with the top of the lock ring 14 being flush with the top of the pipe end adapter 12. Alternatively, the security lock 2 could be installed with the top of the lock ring 14 recessed below the top of the pipe end adapter 12. In either case, a substantial majority of the security lock 2 will be recessed within the pipe end adapter 12. However, installing the security lock 2 in the flush position shown in FIG. 12 can make it easier to rotate the security bolts 20 insofar as they are more accessible.

Figure 13:
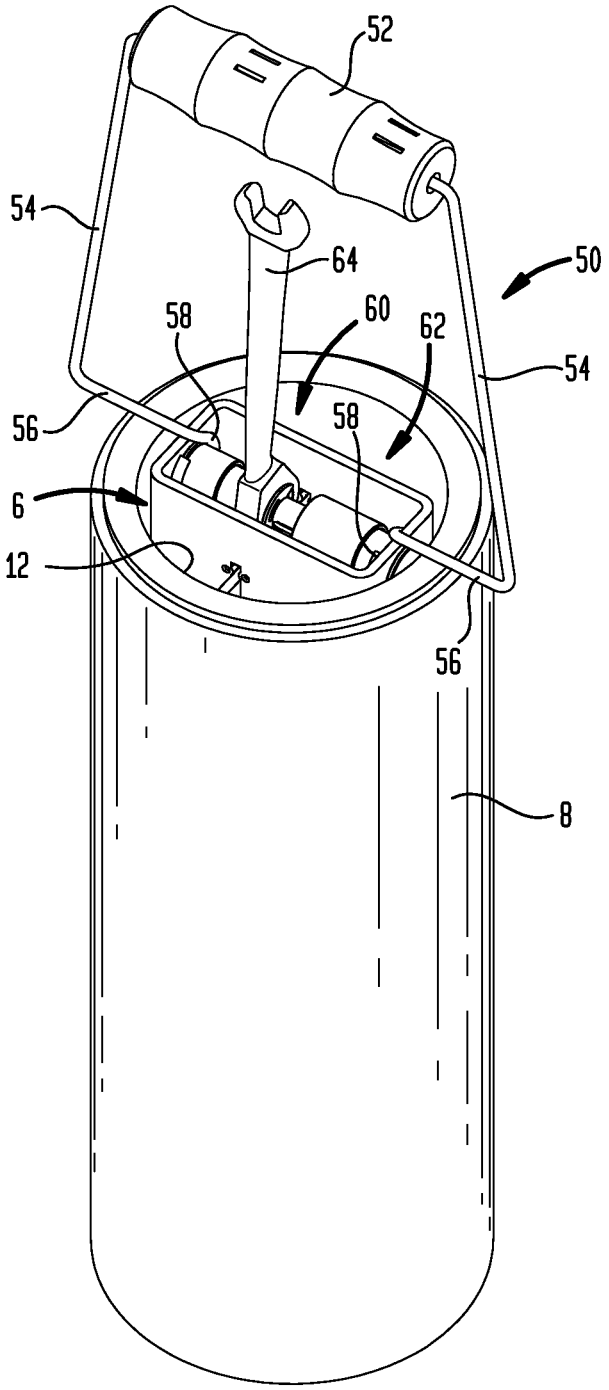
FIG. 13 is a perspective view showing the security lock embodiment of FIG. 2 as it is being installed in the pipe inlet of the storage tank of FIG. 1 using a handle assembly and a security key assembly.
Figure 14:
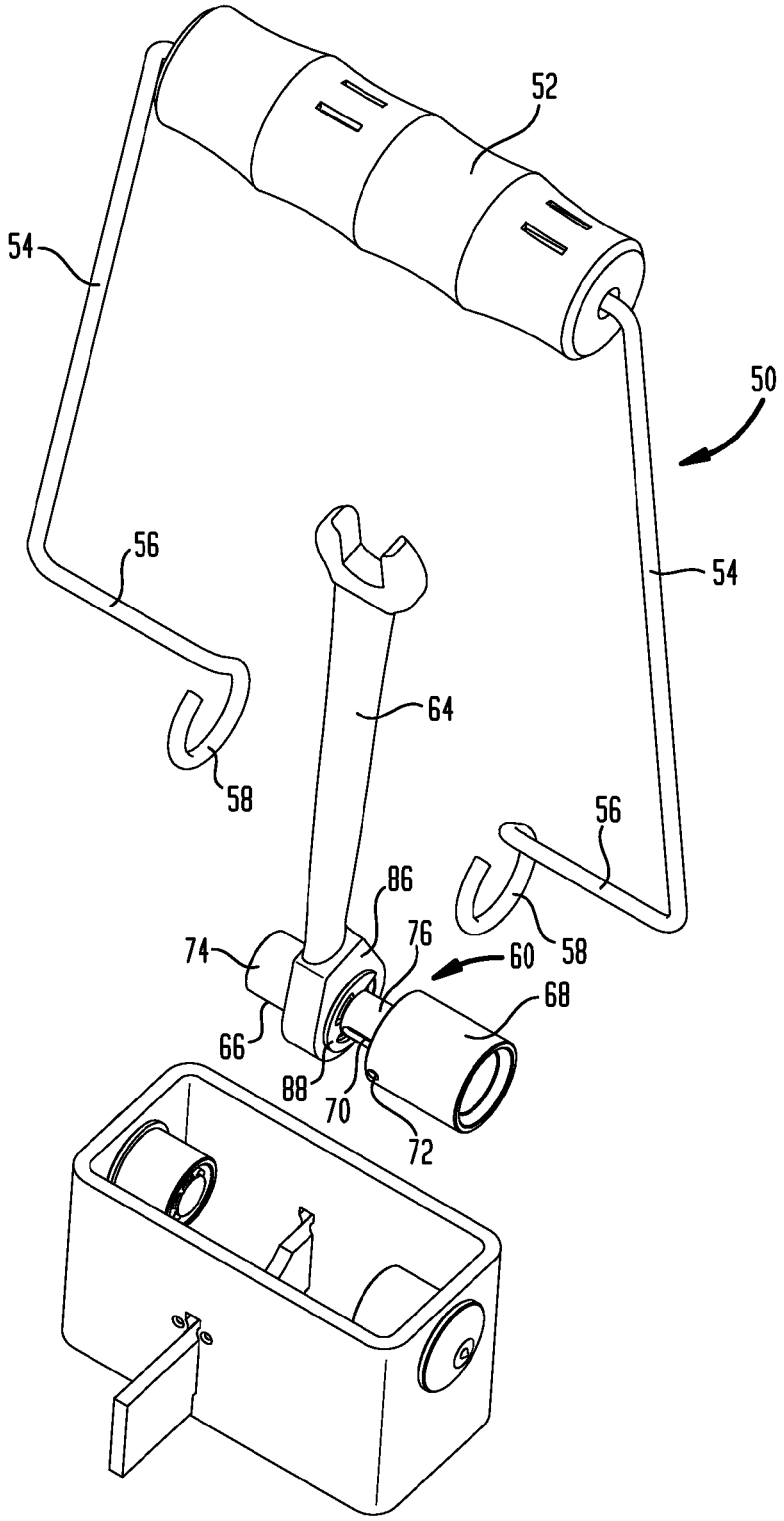
FIG. 14 is an exploded perspective view showing the security lock embodiment of FIG. 2 and the handle assembly and security key assembly of FIG. 13.

Turning now to FIGS. 13 and 14, flush-mounted installation of the security lock 2 may be facilitated by using a handle assembly 50 to hold the security lock in position while the security bolts 20 are tightened. The handle assembly 50 includes an upper handle member 52 adapted to be grasped by the installer. A handle frame, which be made from wire stock material or other suitable material, includes a pair of upper spring arm members 54 that depend downwardly from each end of the handle member 52. A pair of security lock positioning members 56 turn inwardly from the lower ends of the spring arm members 54, and extend generally horizontally therefrom to a pair of loop members 58. As shown in FIG. 13, the loop members are sized to slide over the shrouds 22 of the security lock 2. This may require squeezing together the spring arm members 54 if the nominal spacing of the loop members 58 is wider than the distance between the shrouds 22. Once the security lock 2 is secured to the handle assembly 50, the lock and handle can be maneuvered into the access opening 6 until the positioning members 56 rest on top of the pipe end adapter 12. This will set the vertical position of the security lock 2 to the flush configuration shown in FIG. 12.

A security key assembly 60 may then be used to actuate the security bolts 20. The security key assembly 60 is designed to tighten one of the security bolts 20 while also engaging the other security bolt for stability and to provide affirmative engagement between tool and bolt. It includes a transverse bolt actuation assembly 62 that engages the security bolts and an optional ratchet drive assembly 64 extending away from the bolt actuation assembly. In FIGS. 13 and 14, the left end of the bolt actuation assembly 62 is used to actuate the left hand security bolt 20 while the right end of the bolt actuation assembly engages the right hand security bolt for stability. In this position, the ratchet drive assembly 64 can be ratcheted back and forth in a direction that is generally perpendicular to the main axis of the bolt actuation assembly in order to tighten or loosen the left hand security bolt.

Figure 15:
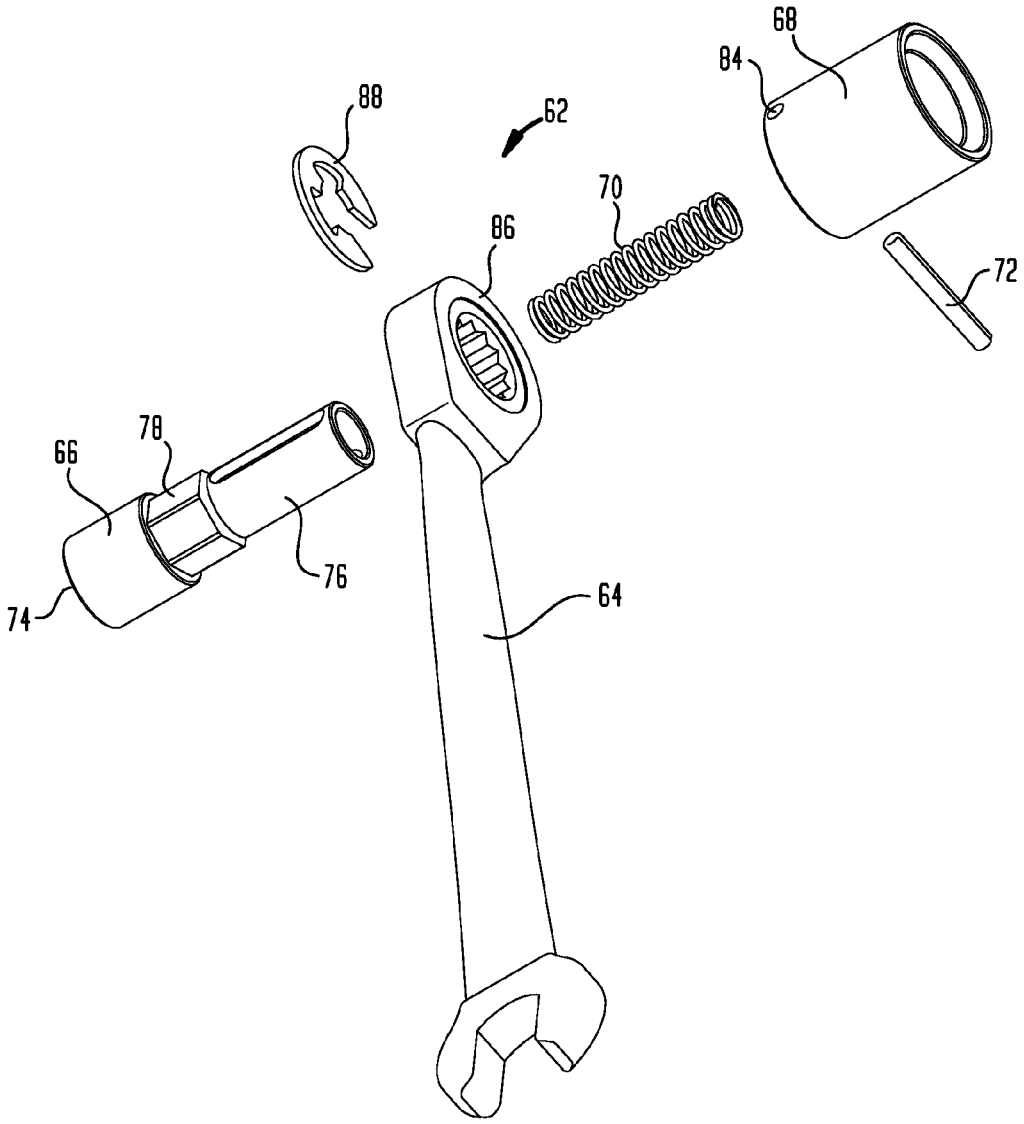
FIG. 15 is an exploded perspective view showing the security key assembly of FIG. 13.
Figure 16:
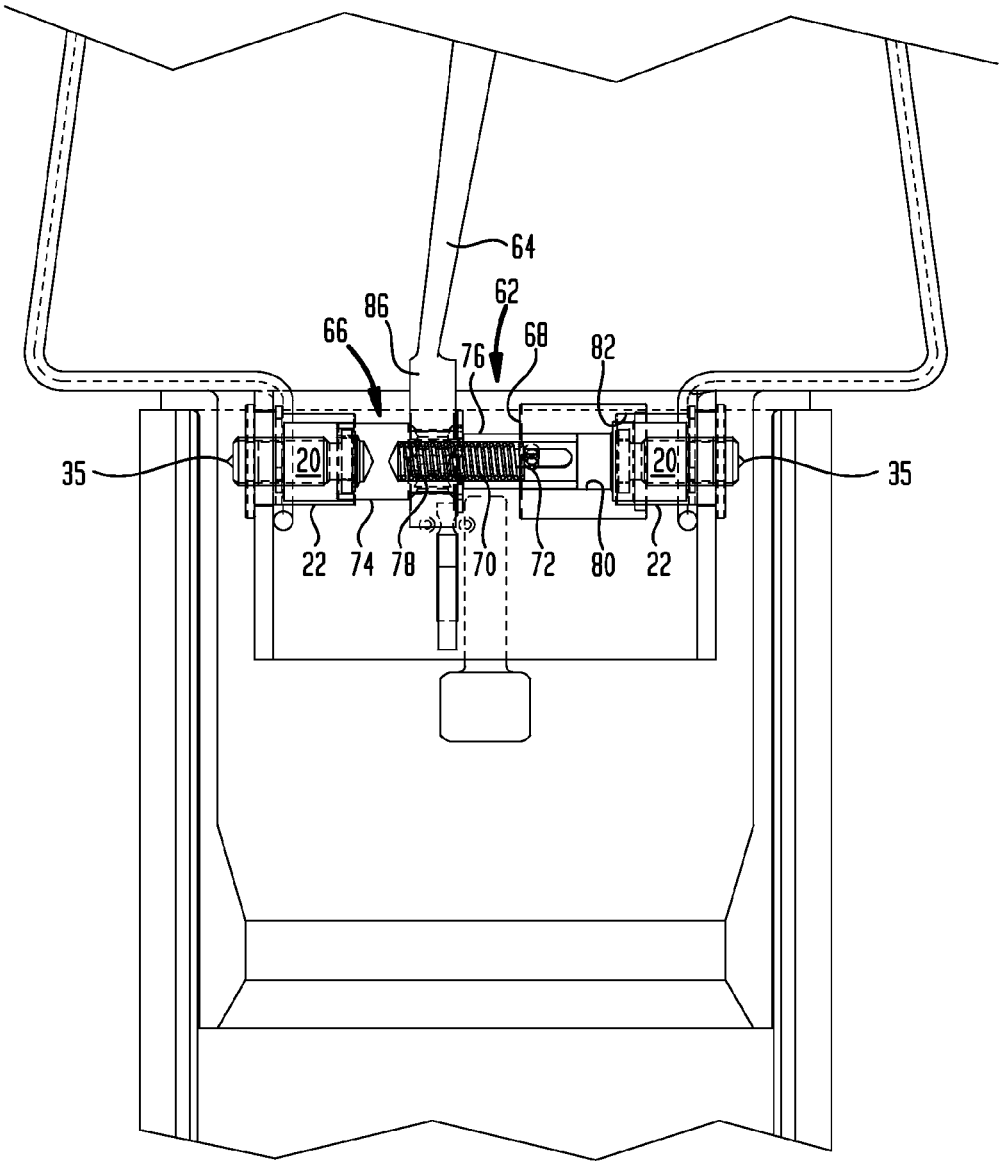
FIG. 16 is a detailed cross-sectional view showing use of the security lock embodiment of FIG. 2 and the handle assembly and security key assembly of FIG. 13.

Example construction and operational details of the security key assembly 60 are shown in FIGS. 15 and 16. As best illustrated in FIG. 16, the bolt actuation assembly 62 may be constructed with a key body member 66, a key shroud member 68, a coil spring 70 and a roll pin 72. The key body member 66 has a patterned security head 74, a slotted hollow shank 76, and a ratchet engagement hub 78. The key shroud member 68 includes a bore 80 on its left end that slidably receives the slotted shank 76 of the key body member 66. As additionally shown in FIG. 16, a two-step counter bore 82 is provided on the right end of the key shroud member 66 in order to engage the end of the right hand shroud 22 shown therein. Returning to FIG. 15, a transverse bore 84 is formed near the left end of the key shroud 68 in order to receive the roll pin 72. The roll pin 72 also extends through the slot portion of the slotted hollow shank 76 of the key body member 66, thus trapping the key body member within the bore 80 of the key shroud member 68. The compression spring 70 is disposed between the roll pin 72 and the base end of the slotted hollow shank 76 of the key body member 66. This arrangement serves to bias the key body member away from the key shroud member 68. The ratchet engagement hub 78 of the key body member 66 may be formed with a standard hex configuration that matches a corresponding drive pattern on a ratchet head portion 86 of the ratchet drive assembly 64. A retaining clip 88 may be used to axially retain the ratchet head portion 86 on the ratchet engagement hub 78.

Figure 17A:
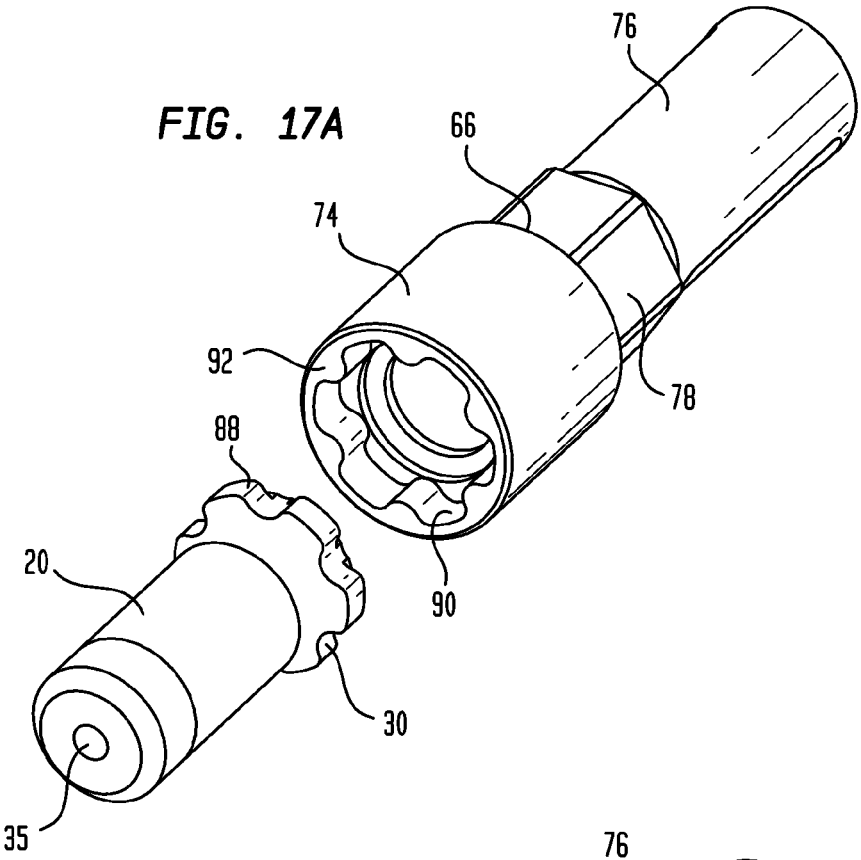
FIGS. 17A and 17B are detailed perspective views showing an example security configuration that may be used on the security key assembly of FIG. 13 and on a security fastener of the security lock embodiment of FIG. 2.
Figure 17B:
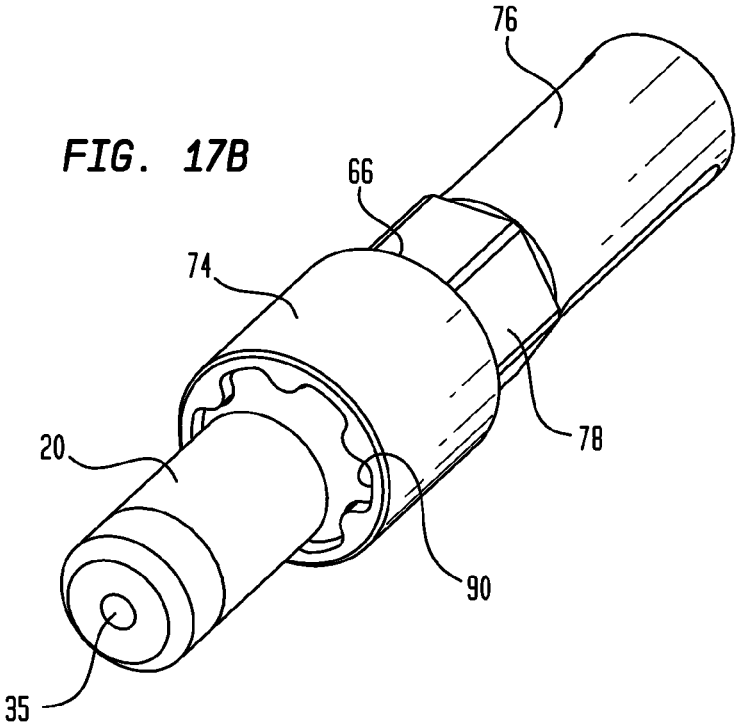

In order to use the security key assembly 60 with security lock 2, the key body member 66 and the key shroud member 68 are squeezed together against the biasing force of the spring 70 until the bolt actuation assembly 62 can be placed into the engagement position of FIG. 16. As stated, in this position, the key shroud member 68 will seat against the end of the right hand shroud 22 while the security head 74 portion of the key body member 66 engages the head 30 left hand security bolt 20 for actuation. As stated, the security head 74 is formed with a security pattern that matches a security pattern on the bolt head 30. One example of such a security pattern is shown in FIGS. 17A and 17B. This pattern comprises a series of lobes 88 of different width on the periphery of the bolt head 30 that engage a corresponding set of recesses 90 formed around a counterbore 92 in the security head 74. Once the security key assembly 60 is mounted as shown in FIG. 16, the ratchet drive assembly 64 can be rocked back and forth to advance or retract the security bolt 20. Note that in lieu of using the integral ratchet drive assembly 64, the ratchet engagement hub 78 of the key body member 66 could be actuated using a standard end wrench.

EXAMPLE EMBODIMENT 2

Figure 18:
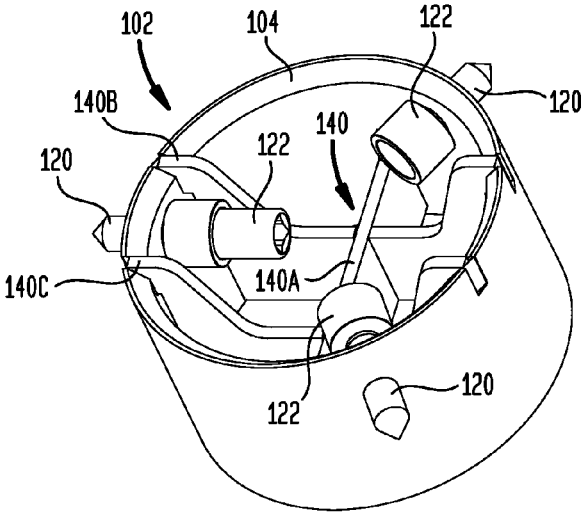
FIG. 18 is a perspective view showing a second example security lock embodiment that may be constructed in accordance with the present disclosure.
Figure 20:
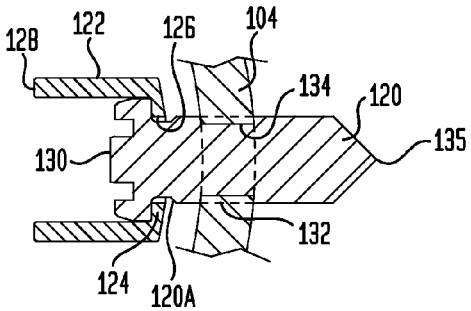
FIG. 20 is a cross-sectional view taken along line 20-20 in FIG. 19.
Figure 19:
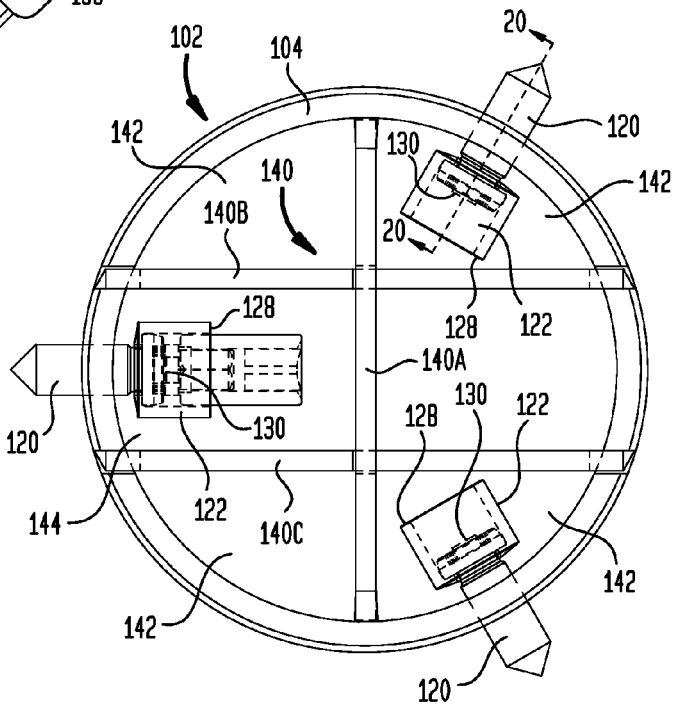
FIG. 19 is a top plan view showing the first alternate security lock embodiment of FIG. 18.

Turning now to FIGS. 18-20, a storage tank security lock 102 constructed in accordance with a second example embodiment is shown. The security lock 102 differs from the security lock 2 in that its lock ring 104 is generally circular in shape. In addition, there are three shrouded security fasteners spaced equidistantly from each other around the lock ring 104. Each shrouded security fastener comprises a security bolt 120 disposed within a free-spinning shroud 122. As best shown in FIG. 20, each shroud 122 includes a base 124 having a central bore 126 that is captured in a bolt shank undercut 120A of one of the security bolts 120. A tubular shroud body 128 extends inwardly into the lock ring interior and is sized to surround the head portion 130 of each security bolt 120. The shroud body 128 is preferably closely spaced with respect to the bolt head 130 so as to limit the ability to grip the bolt head with an unauthorized tool. Each security bolt 120 has a threaded portion 132 that extends through a threaded bore 134 of the lock ring 104. The outwardly extending ends of the security bolts may be formed with points 135 to facilitate mounting of the security lock 102 in a storage tank access opening.

A grate structure 140 comprises perpendicular grate parts; namely, a central grate part 140A and two lateral grate parts 140B and 140C. The grate parts 140A, 140B and 140C define four generally pie-shaped openings 142 and two generally rectangular openings 144. As can be seen in FIG. 18, the grate part 140A is of reduced height so as to provide clearance for a security key assembly (described below) that may be used to adjust the security bolts 120. The grate parts 140B and 140C have matching height where they intersect the grate part 140A, then optionally increase in height toward their point of intersection with the lock ring 104.

Figure 22:
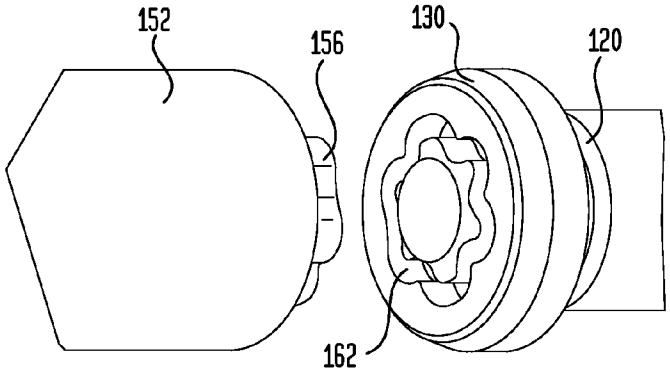
FIG. 22 is a detailed perspective view showing an example security configuration that may be used on the alternate security key assembly of FIG. 21 and on a security fastener of the first alternative security lock embodiment of FIG. 18.
Figure 23:
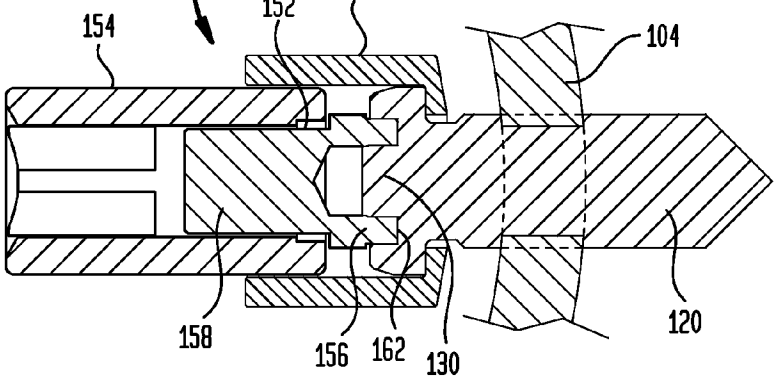
FIG. 23 is a cross-sectional centerline view showing the alternate security key assembly of FIG. 21 engaging a security fastener of FIG. 22.
Figure 21:
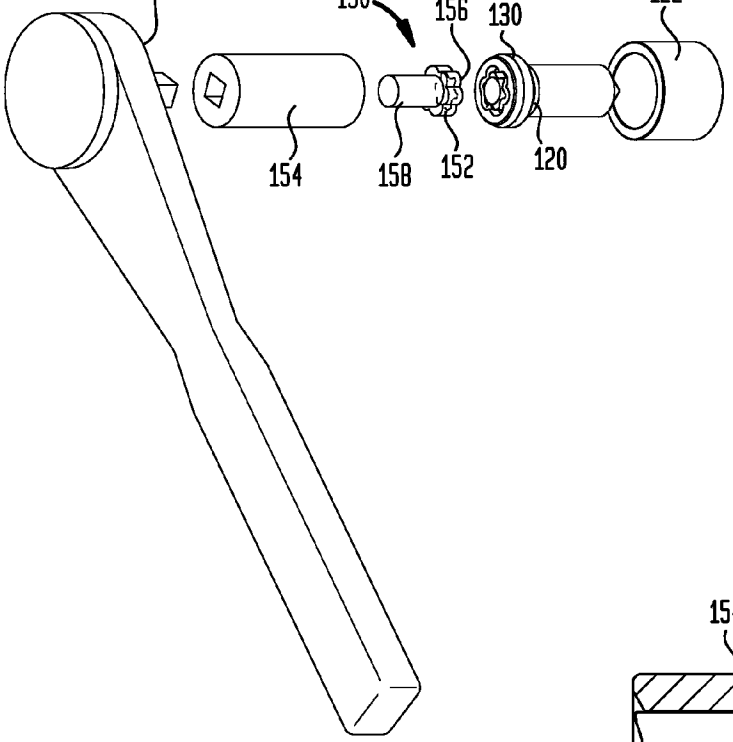
FIG. 21 is an exploded perspective view showing an alternate security key assembly that may be used with the first alternate security lock embodiment of FIG. 18.

As shown in FIGS. 21-22, a security key assembly 150 may be used to actuate the security bolts 120. The security key assembly 150 is designed to tighten one security bolt 120 at a time. It includes a key head 152 that engages the security bolts and a key body 154. The key head 152 includes a security pattern 156 and a key body engagement hub 158. As best shown in FIG. 22, the security pattern 156 may be formed as a continuous curvilinear ridge. The head 130 of each security bolt 120 may be formed with a complimentary curvilinear security groove 162. The inter-engagement between the security key assembly 150 and one of the shrouded security fasteners is shown in FIG. 23. As can be seen, the key head security pattern 156 is interlocked with the security groove 162 on the security bolt head 130. At the same time, the key body 154 is received within the shroud 122 so as to stabilize the security key assembly 150 during the security bolt adjustment operation.

EXAMPLE EMBODIMENT 3

Figure 24:
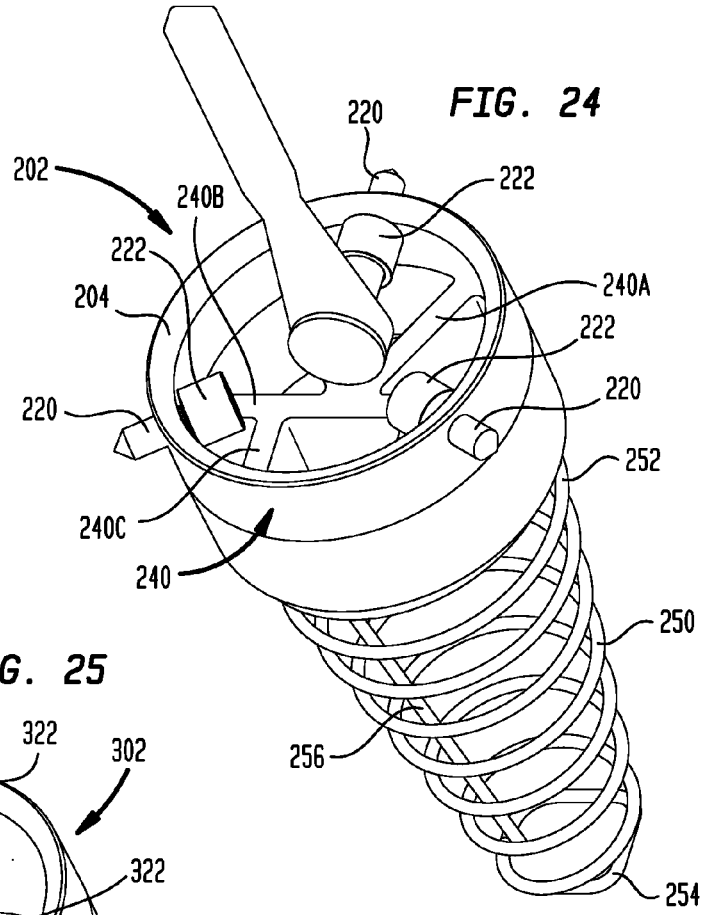
FIG. 24 is a perspective view showing a third example security lock embodiment that may be constructed in accordance with the present disclosure.

Turning now to FIG. 24, a storage tank security lock 202 constructed in accordance with a third example embodiment is shown. The security lock 202 is similar to the security lock 102 of FIGS. 18-20, and this similarity is shown by the use of corresponding reference numbers, incremented by 100, to designate like structure. For example, the security lock 202 includes a lock ring 204 and three shrouded fasteners that each comprise a security bolt 220 in combination with a free-spinning shroud 222. Where the security lock 202 differs from the security lock 102 is the design of its grate structure and the inclusion of additional obstruction capability. In particular, the grate structure 240 comprises oblique grate parts 240A, 240B and 240C that define several grate openings of various shape and size. The additional obstruction comprises a conical spring 250 (referred to as a "lock spring") that is fastened to the lock ring 204 to provide a blocking obstruction that partially blocks the area inside the lock ring. The upper end 252 of the lock spring 250 has a relatively large diameter and is fastened to the lock ring 204. The lower free end 254 of the lock spring 250 has a relatively small diameter. The small end 254 is sized and shaped to allow a measuring stick or other instrument to pass through the center thereof, but to prevent larger pipes or hoses from passing through and entering the storage tank. The lock spring 250 is fastened onto a suitable portion of the lock ring 204, such as its lower edge or inside wall face. The lock spring 250 may be attached to the lock ring 204 by welding, crimping, or any other suitable method. Following installation of the security lock 202, the small end 254 of the lock spring 250 points towards the tank contents that are to be secured and stored. One or more straight "side wires" or other structures 256 may be fastened along the inside of the lock spring 250 to add rigidity and prevent deformation, stretching, bending, or other damage caused by any attempt to compromise the lock and its security features.

EXAMPLE EMBODIMENT 4

Figure 25:
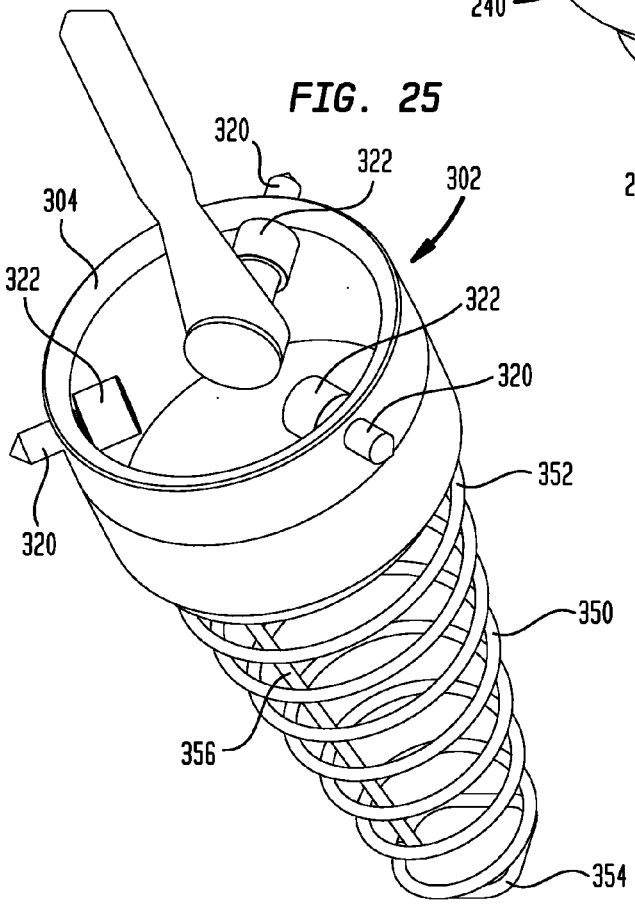
FIG. 25 is a perspective view showing a fourth example security lock embodiment that may be constructed in accordance with the present disclosure.

Turning now to FIG. 25, a storage tank security lock 302 constructed in accordance with a fourth example embodiment is shown. The security lock 302 is similar to the security lock 202 of FIG. 24, and this similarity is shown by the use of corresponding reference numbers, incremented by 100, to designate like structure. For example, the security lock 302 includes a lock ring 304 and three shrouded fasteners that each comprise a security bolt 320 in combination with a spinning shroud 322. The security lock 302 also includes a lock spring 350 having a large diameter upper end 352 secured to the lock ring 304, a small diameter lower end 354, and a rigidity-enhancing side wire 356. Where the security lock 302 differs from the security lock 202 is that lacks a grate structure and instead relies solely on the lock spring 350 to serve as the obstruction.

EXAMPLE EMBODIMENT 5

Figure 26:
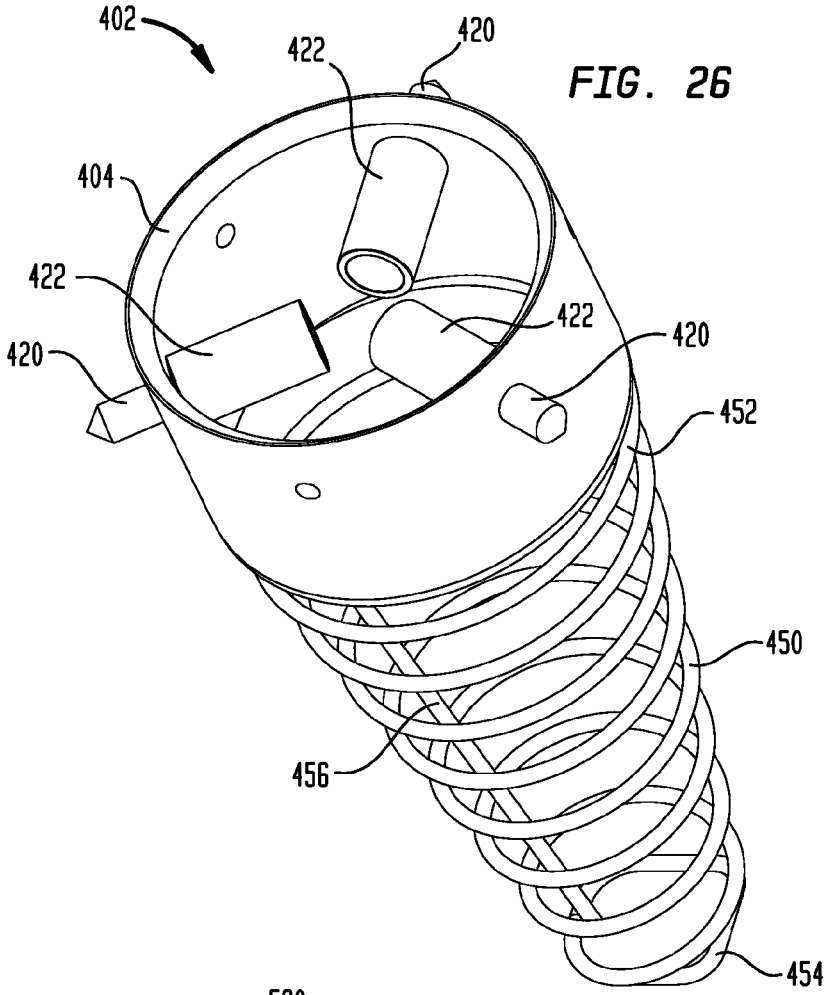
FIG. 26 is a perspective view showing a fifth example security lock embodiment that may be constructed in accordance with the present disclosure.

Turning now to FIG. 26, a storage tank security lock 402 constructed in accordance with a fifth example embodiment is shown. The security lock 402 is similar to the security lock 302 of FIG. 25, and this similarity is shown by the use of corresponding reference numbers, incremented by 100, to designate like structure. For example, the security lock 402 includes a lock ring 404 and three shrouded fasteners that each comprise a security bolt 420 in combination with a spinning shroud 422. The security lock 402 also includes a lock spring 450 having a large diameter upper end 452 secured to the lock ring 404, a small diameter lower end 454, and a rigidity-enhancing side wire 456. Where the security lock 402 differs from the security lock 302 is that the shrouds 422 are lengthened or otherwise made larger to partially block the area defined by the lock ring 404, thereby providing several obstructions that define several openings inside the lock ring.

EXAMPLE EMBODIMENT 6

Figure 27:
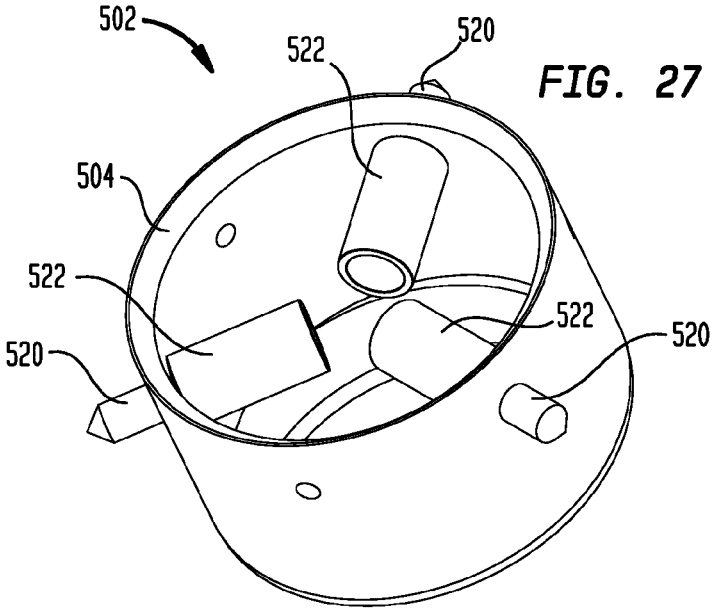
FIG. 27 is a perspective view showing a sixth example security lock embodiment that may be constructed in accordance with the present disclosure.

Turning now to FIG. 27, a storage tank security lock 502 constructed in accordance with a sixth example embodiment is shown. The security lock 502 is similar to the security lock 402 of FIG. 26, and this similarity is shown by the use of corresponding reference numbers, incremented by 100, to designate like structure. For example, the security lock 502 includes a lock ring 504 and three shrouded fasteners that each comprise a security bolt 520 in combination with a spinning shroud 522. Like the shrouds 422 in the embodiment of FIG. 26, the shrouds 522 are lengthened or otherwise made larger to partially block the area defined by the lock ring 504, thereby providing several obstructions that define several openings inside the lock ring. Where the security lock 502 differs from the security lock 402 is that it lacks a lock spring, and relies solely on the shrouds 522 to provide the obstructions.

Accordingly, a storage tank security lock and installation method have been disclosed. While various embodiments of the invention have been described, it should be apparent that many variations and alternative embodiments could be implemented in accordance with the invention. For example, although the lock rings disclosed in the illustrated embodiments are continuous closed ring structures, they could also be discontinuous open ring structures (i.e., with one or more gaps in the ring sidewall). It is understood, therefore, that the invention is not to be in any way limited except in accordance with the spirit of the appended claims and their equivalents.

What is claimed is:

1. A security lock for a storage tank, comprising:

a lock ring configured for engaging an opening that provides access to said storage tank;

a mounting assembly operable to mount said lock ring to said opening;

said security lock comprising one or more obstructions disposed within an inside (and/or outside) area of said lock ring, said one or more obstructions defining one or more openings that are sized to allow storage tank contents to be introduced through said security lock while blocking pipes, tubes or other implements that are larger than said openings so that they cannot be used for siphoning or otherwise removing said storage tank contents;

said lock ring being generally rectangular; and said lock ring having a pair of long sidewalls and a pair of short sidewalls, a shrouded security fastener on each short sidewall, and a grate bar extending generally perpendicular to said long sidewalls.

2. The security lock of claim 1, wherein said security fasteners comprise outwardly directed locking security fasteners on said ring, said security fasteners being operable to engage and grip an internal surface of said opening.

3. The security lock of claim 2, wherein said security fasteners each comprise a security lock pattern on a head portion thereof that requires a matching security key to rotate said security fasteners.

4. The security lock of claim 3, wherein said security fasteners each comprise a shroud respectively mounted to surround said head portion to prevent said security fasteners from being gripped and rotated by an unauthorized tool.

5. The security lock of claim 4 wherein said shrouds are non-spinning.

6. The security lock of claim 4 wherein said shrouds are free-spinning.

7. The security lock of claim 1, wherein said one or more obstructions comprise a grate.

8. The security lock of claim 4, wherein said one or more obstructions comprise lengthened or larger shrouds that protrude into the center of the ring provide at least one of said one or more obstructions.

9. The security lock of claim 1 wherein said lock ring is a continuous structure such that said lock ring is a closed ring.

10. The security lock of claim 1 wherein said one or more obstructions comprise said grate bar acting in conjunction with said rectangular lock ring to form a grate structure that blocks unauthorized access to tank contents, said grate bar being arranged to divide an inside area of said rectangular lock ring and areas outside said rectangular lock ring that are formed between said long sidewalls and a sidewall of said storage tank access opening when said lock ring is installed.

11. The security lock of claim 10 wherein each long sidewall of said rectangular ring is formed with a vertical main slot, said slots being aligned with each other to receive said grate bar, said grate bar having two lower mounting slots that respectively engage lower ends of said main slots on said long sidewalls.

12. The security lock of claim 11 wherein upper ends of said main slots are suitably deformed (as by staking) to secure said grate bar against upward movement and to interlock said grate bar mounting slots with said main slots.

13. A security lock for a storage tank, comprising:

a lock ring configured for engaging an opening that provides access to said storage Tank;

a mounting assembly operable to mount said lock ring to said opening;

said security lock comprising one or more obstructions disposed within an inside (and/or outside) area of said lock ring, said one or more obstructions defining one or more openings that are sized to allow storage tank contents to be introduced through said security lock while blocking pipes, tubes or other implements that are larger than said openings so that they cannot be used for siphoning or otherwise removing said storage tank contents;

said mounting assembly comprising one or more removable security fasteners;

said one or more security fasteners comprising one or more outwardly directed locking security fasteners on said ring, said one or more security fasteners being operable to engage and grip an internal surface of said opening;

said one or more security fasteners each comprising a security lock pattern on a head portion thereof that requires a matching security key to rotate said security fasteners;

said one or more security fasteners each comprising a shroud respectively mounted to surround said head portion to prevent said security fasteners from being gripped and rotated by an unauthorized tool; and a handle assembly that engages said shrouds and holds said security lock in a desired installation position in said access opening during installation.

14. A security lock for a storage tank, comprising:

a lock ring configured for engaging an opening that provides access to said storage tank;

a mounting assembly operable to mount said lock ring to said opening;

said security lock comprising one or more obstructions disposed within an inside (and/or outside) area of said lock ring, said one or more obstructions defining one or more openings that are sized to allow storage tank contents to be introduced through said security lock while blocking pipes, tubes or other implements that are larger than said openings so that they cannot be used for siphoning or otherwise removing said storage tank contents;

said mounting assembly comprising one or more removable security fasteners;

said one or more security fasteners comprising one or more outwardly directed locking security fasteners on said ring, said one or more security fasteners being operable to engage and grip an internal surface of said opening;

said one or more security fasteners each comprising a security lock pattern on a head portion thereof that requires a matching security key to rotate said security fasteners;

said one or more security fasteners each comprising a shroud respectively mounted to surround said head portion to prevent said security fasteners from being gripped and rotated by an unauthorized tool; and a security key tool comprising a first portion configured to engage said security lock pattern on said head portion of a first one of said security fasteners, and a second portion configured to engage a shroud of a second one of said security fasteners in order to stabilize said security key tool.

15. The security lock of claim 14 wherein said first portion and said second portion of said security tool are part of a transverse fastener actuation assembly that also mounts a ratchet drive assembly for rotating said first one of said security fasteners.

16. A method for securing a storage tank access opening, comprising:

providing a storage tank security lock, said security lock comprising:

a lock ring configured for engaging an opening that provides access to said storage tank;

a mounting assembly operable to mount said lock ring to said opening, said mounting assembly including a pair of opposing security fasteners each having a security lock pattern on a head portion thereof that requires a matching security key to rotate said security fasteners, each security fastener also having a shroud respectively mounted to surround said head portion to prevent said security fastener from being gripped and rotated by an unauthorized tool; and said security lock comprising one or more obstructions disposed within an inside (and/or outside) area of said lock ring, said one or more obstructions defining one or more openings that are sized to allow storage tank contents to be introduced through said security lock while blocking pipes, tubes or other implements that are larger than said openings so that they cannot be used for siphoning or otherwise removing said storage tank contents;

temporarily attaching said security lock to a handle assembly that engages said shrouds and includes a lock positioning structure adapted to rest on top of said access opening with said security lock in an installation position;

using said handle assembly to lower said security lock into said access opening until said lock positioning structure engages said top of said access opening;

attaching said security lock to said access opening using a security key tool that includes a first portion configured to engage said security lock pattern on said head portion of a first one of said security fasteners, and a second portion configured to engage a shroud of a second one of said security fasteners in order to stabilize said security key tool; and said security lock being attached to said access opening by using said security key tool to rotate said first one of said fasteners into locking engagement with said access opening, and further using said security key tool to rotate said second one of said fasteners into locking engagement with said access opening.

* * * * *